United States Patent [19]

Donnelly

[11] Patent Number: 4,635,912

[45] Date of Patent: Jan. 13, 1987

[54] WORK RELEASE STOP FOR A VISE

[76] Inventor: James E. Donnelly, 930 Malotte La., Gastonia, N.C. 28052

[21] Appl. No.: 735,140

[22] Filed: May 17, 1985

[51] Int. Cl.[4] ..... B25B 1/00

[52] U.S. Cl. ..... 269/157; 269/160; 269/317

[58] Field of Search ..... 269/157, 159, 160, 317, 269/318, 244

[56] References Cited

U.S. PATENT DOCUMENTS

| | | | |
|---|---|---|---|
| 985,209 | 2/1911 | Russell | 269/157 |
| 1,128,144 | 2/1915 | Inwood et al. | 269/43 |
| 1,578,197 | 3/1926 | Keyes | 269/157 |
| 2,638,676 | 5/1953 | Callahan | 269/43 |

*Primary Examiner*—Frederick R. Schmidt
*Assistant Examiner*—Judy J. Hartman
*Attorney, Agent, or Firm*—Bell, Seltzer, Park & Gibson

[57] ABSTRACT

The work release stop of the present invention is adapted for use with conventional types of vises for engaging and limiting the rearward movement of the adjustable jaw of the vise when releasing a workpiece clamped between the fixed jaw and the adjustable jaw to facilitate the repetitive clamping and unclamping of workpieces positioned in the vise. The work release stop acts as an adjustable stop for the adjustable jaw and includes a stop plate extending transversely of the adjustable jaw and divided into first and second parts. Gripping jaw portions extend downwardly into the guideway slot of the vise and are engageable with opposite sides to thereby maintain the stop plate in longitudinally adjusted position in the guideway. A compression spring urges the adjustable jaw in a rearward position to reduce any "play" between the adjustable jaw and the operating screw shaft.

10 Claims, 4 Drawing Figures

WORK RELEASE STOP FOR A VISE

FIELD OF THE INVENTION

This invention relates generally to a work release stop for a vise and more particularly to such a stop which may be positioned in various adjusted locations along the vise guideway for adapting the vise to repetitive clamping and unclamping of various sizes of workpieces between the adjustable and fixed jaws.

BACKGROUND OF THE INVENTION

Vises are usually employed in machine shops and the like for temporarily holding various sizes of workpieces in the desired position for drilling and the like. The adjustable jaw of the vise is usually moved forwardly toward and rearwardly away from the fixed jaw by rotating a handle connected to a screw shaft on which the adjustable jaw is supported. When unclamping the workpiece it is the usual practice to rotate the handle a greater distance than is actually required to provide sufficient clearance for removal of the workpiece so that a greater amount of rotation must be again applied to the handle when moving the adjustable jaw back into clamping position with a subsequent workpiece. There is usually some "play" between the external threads of the screw shaft and the internal threads of the adjustable jaw so that it is usually necessary to rotate the handle a greater distance than the amount required to move the adjustable jaw when both clamping and unclamping the workpiece. These problems are not significant except when repetitively clamping and unclamping a particular size of workpiece in the vise for repetitive drilling operations and the like.

It is generally known to adapt a vise to repetitive clamping and unclamping of a particular size of workpiece without requiring excessive rotation of the handle. For example, U.S. Pat. No. 1,279,011 discloses providing a separate handle supported in an eccentric manner between the adjustable jaw and the connection with the screw shaft so that rotation of the handle imparts limited forward and rearward movement to the adjustable jaw to provide a quick adjustment for clamping and unclamping workpieces of the same size. However, the addition of this handle is costly and requires extensive modification of a conventional type of vise. U.S. Pat. No. 2,818,786 discloses a vise equipped with a separate elbow lever mechanism for rapid and repetitive clamping and unclamping of workpieces. The elbow lever mechanism supported in a position to be rocked by an eccentric carried by a manually movable handle to move a portion of the elbow lever into and out of clamping engagement with the workpiece. The adoption of this type of clamping and unclamping device is also costly and requires substantial modification of a conventional type of vise.

SUMMARY OF THE INVENTION

With the foregoing in mind, it is an object of the present invention to provide a simple and inexpensive work release stop member which is readily adaptable to a conventional type vise and is easily and quickly installed on the vise. The work release stop member may be positioned in various adjusted locations along the vise guideway to limit the amount of rearward movement of the adjustable jaw away from the fixed jaw and to adapt the vise to the repetitive clamping and unclamping of particular size workpieces in the vise.

The present work release stop does not interfere with the normal clamping and unclamping operation of the adjustable jaw and is attached to and moves with the adjustable jaw so that it may be easily utilized for repetitive clamping and unclamping of particular size workpieces. The work release stop is also provided with resilient means for resiliently urging the adjustable jaw of the vise toward the stop means and away from the fixed jaw to reduce any "play" between the adjustable jaw and the operating screw shaft.

The present work release stop includes a stop plate vertically divided to define separate first and second transversely adjacent parts and extending transversely of the adjustable jaw with an upper portion extending transversely of and above the guideway of the vise. Lower shoulder portions are provided on opposite sides of the stop plate and are supported on horizontal portions adjacent opposite sides of the guideway while gripping jaw portions extend downwardly below the shoulder portions and are engageable with opposite facing sides of the guideway. Adjustment means is provided for varying the transverse distance between the first and second stop plate parts and for varying the distance between the gripping jaw portions so that the stop plate may be maintained in a selected longitudinally adjusted position along the guideway. The adjustment means for varying the transverse distance between the gripping jaw portions includes a bearing ball partially seated in the first part of the stop plate and an adjusting screw threadably supported in the second part of the stop plate and being movable into engagement with the bearing ball to force the gripping jaws apart and into gripping relationship with opposite side portions of the guideway.

The resilient means for maintaining the adjustable jaw in a rearwardmost position on the operating screw shaft includes a shaft member slidably penetrating the stop plate and having a forward end threadably supported in the adjustable jaw. The shaft member includes a rearwardly extending portion extending outwardly beyond the stop plate and a compression spring surrounds the rearwardly extending portion of the shaft member with its forward end in engagement with the stop plate and its rear end being adjustably connected to the rear end of the shaft member so that the amount of rearward resilient force exerted on the adjustable jaw may be varied.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
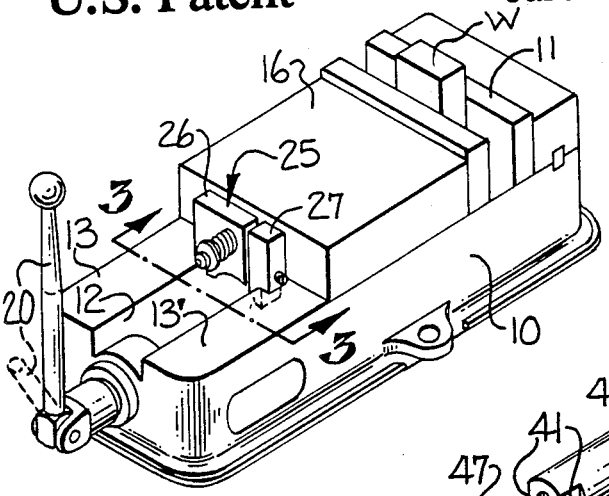
FIG. 1 is an isometric view of a conventional type of vise with the work release stop of the present invention position thereon.

The work release stop member of the present invention, broadly indicated at 25, is illustrated in FIG. 1 in association with a particular type of vise. However, it is to be understood that this work release stop member 25 can be used in association with other types of vises to quickly adapt the same for efficient repetitive clamping and unclamping of a particular size of workpiece. The vise includes an elongate base 10 with a fixed jaw 11 at one end of the elongate base 10. A guideway in the form of a slot 12 extends longitudinally along the base 10 and from the fixed jaw 11 to the opposite end portion thereof. The guideway slot 12 is defined by spaced-apart vertical side walls and horizontal guide surfaces 13, 13' extend horizontally from the upper ends of the side walls of the guideway slot 12.

A screw shaft 15 is journaled for rotation at each end of the base 10 and extends along the guideway slot 12. An adjustable jaw 16 is supported for longitudinal sliding movement on the horizontal slide portions 13, 13' of the base 10 and includes a depending guide 17 (FIG. 4) extending into the guideway slot 12 and having an internally threaded bore threadably receiving the external threads on the screw shaft 15. The adjustable jaw 16 is thus supported for movement forwardly toward and rearwardly away from the fixed jaw 11 with rotation of the screw shaft 15 in opposite directions. A suitable handle 20 is connected to the rear end portion of the screw shaft 15 which extends outwardly beyond the base 10 for imparting manual rotation to the screw shaft 15.

Figure 3:
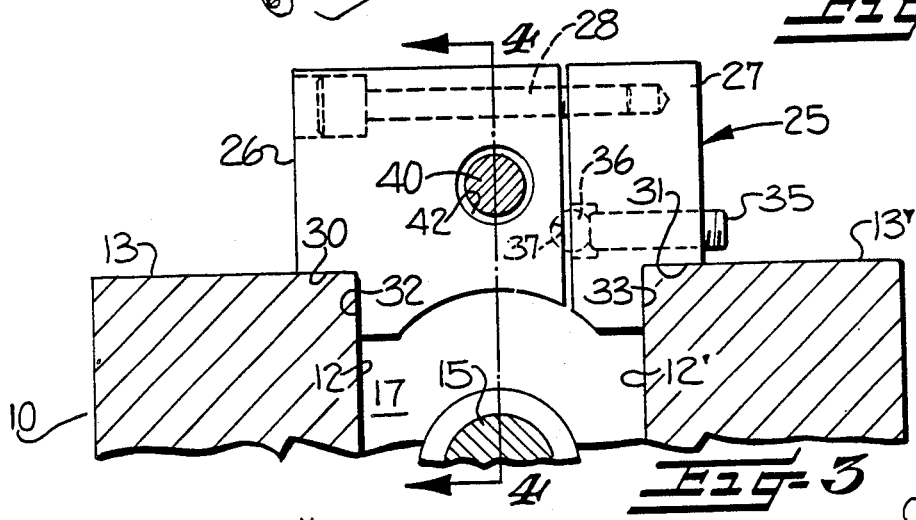
FIG. 3 is an enlarged fragmentary vertical sectional view taken substantially along the line 3—3 in FIG. 1.

The work release stop member 25 of the present invention acts as adjustable stop means for the adjustable jaw 16 and is supported for longitudinal movement in the guideway slot 12. The stop member 25 is fixed in spaced relationship rearwardly of the adjustable jaw 16 when the adjustable jaw 16 is in the workpiece clamping position for engaging and limiting rearward movement of the adjustable jaw 16 when releasing a workpiece, as indicated at W, clamped between the fixed jaw 11 and the adjustable jaw 16. The work release stop member 25 includes a stop plate which is vertically divided to define separate first and second transversely adjacent parts 26, 27 with the upper portions thereof extending transversely of the adjustable jaw 16 and above the guideway slot 12. One end of a threaded connector screw 28 is supported in a counterbored hole in the first part 26 of the stop plate and its other end is supported in a threaded hole in the second part 27. As illustrated in FIG. 3, the threaded screw 28 can be rotated to vary the overall width and the distance between the first and second parts 26, 27 of the stop plate.

The lower portions of the first and second parts 26, 27 are provided with respective horizontal shoulders 30, 31 supported on the horizontal portions 13, 13' and adjacent opposite sides of the guideway slot 12. Vertical gripping jaw portions or members 32, 33 extend downwardly below the respective shoulder portions 30, 31 and are engageable with opposite side walls of the guideway slot 12, as illustrated in FIG. 3.

Figure 2:
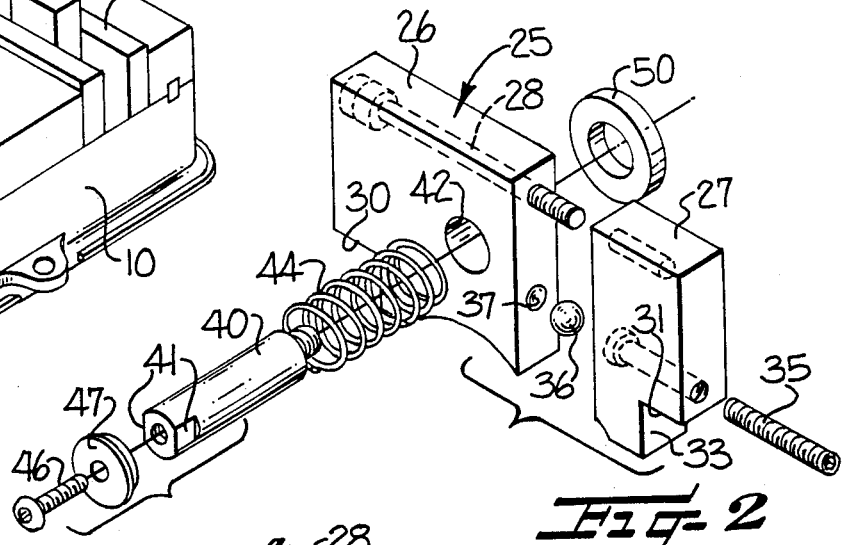
FIG. 2 is an exploded isometric view of the present work release stop, removed from the vise.

Adjustment means is provided for varying the distance between the gripping jaw members 32, 33 to maintain the work release stop member 25 in longitudinally adjusted position in the guideway slot 12. The adjustment means includes an adjustment screw 35 threadably supported an internally threaded bore in the second part 27 of the stop plate and below the threaded connector screw 28. The inner end of the adjustment screw 35 engages a bearing ball 36 positioned in a counter bore in the second part 27 and having its opposite surface seated in a suitable seat 37 (FIG. 2) in the adjacent surface of the second part 26 of the stop plate. Thus, when the adjustment screw 35 is rotated to move the same inwardly of the second part 27, the distance between the gripping jaw members 32, 33 increases and they move into gripping engagement with the opposite side walls of the guideway slot 12. When the adjustment screw 35 is rotated in the opposite direction, the gripping engagement between the gripping jaws 32, 33 and the side walls of the guideway slot 12 is released and the work release stop member 25 is longitudinally moved along the guideway slot 12 with movement of the adjustable jaw 16, in a manner to be presently described.

Figure 4:
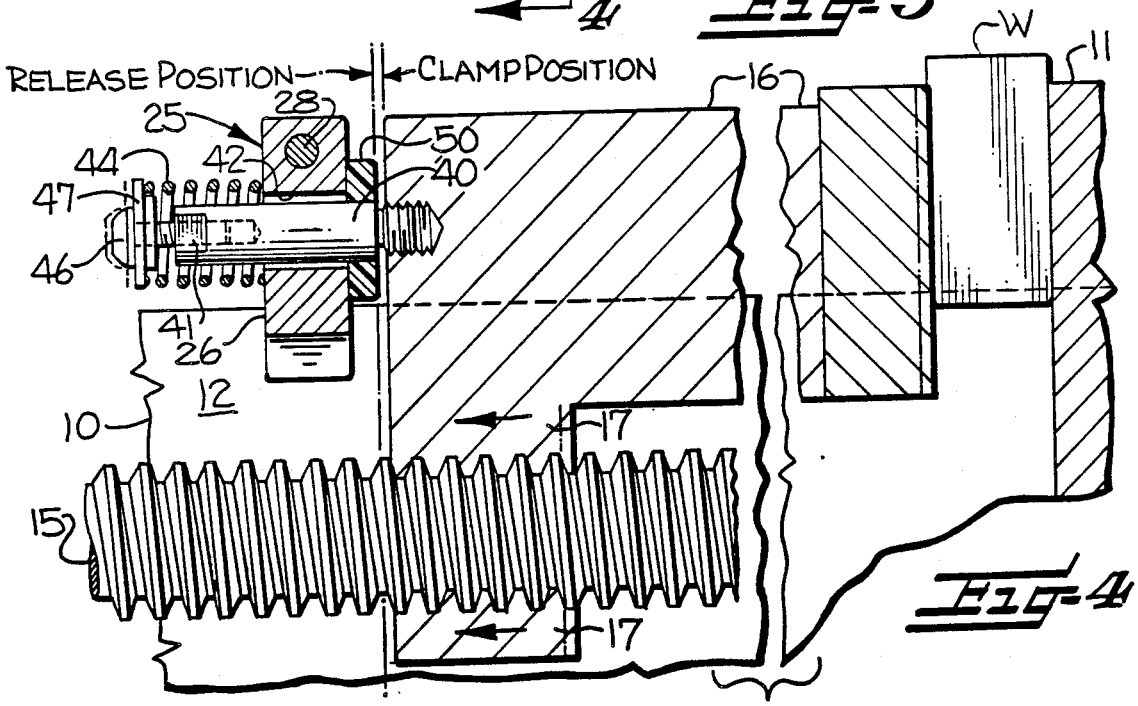
FIG. 4 is a fragmentary vertical sectional view taken substantially along the line 4—4 in FIG. 3.

Resilient means is supported on the work release stop member 25 and is connected to the adjustable jaw 16 for resiliently urging the adjustable jaw 16 rearwardly and toward the work release stop member 25. This resilient means includes a shaft member 40 having a threaded forward end threadably supported in a threaded bore in the rear face of the adjustable jaw 16 (FIG. 4). The rear end of the shaft member 40 is provided with flats 41 to facilitate screwing the shaft member 40 into the threaded bore in the adjustable jaw 16.

The shaft member 40 extends rearwardly through a bore 42 in the first part 26 of the stop plate and extends outwardly therebeyond. A compression spring 44 surrounds the rear portion of the shaft member 40 and the forward end of the spring 44 engages and seats against the first part 26 of the stop plate. The forward end of an adjustment screw 46 is threadably supported in a threaded bore in the rearward end of the shaft member 40 and penetrates a shouldered spring support washer 47. Adjustment of the adjustment screw 46 inwardly and outwardly varies the compressive force of the spring 44 against the rear face of the first part 26 of the stop plate and thus varies the resilient force with which the adjustable jaw 16 is urged toward the work release stop member 25 and thereby reduces any "play" between the internal threads of the depending portion 17 and the external threads on the screw shaft 15. A plastic washer 50 is positioned between the work release stop member 25 and the adjustable jaw 16 and surrounds the inner portion of the shaft member 40 to act as a "bumper" stop when the adjustable jaw 16 is moved between the clamped position, shown in solid lines in FIG. 4, and the unclamped or released position, shown in dotted lines therein.

The work release stop member 25 of the present invention is easily applied to the conventional type of vise by merely drilling and tapping a hole in the rear face of the adjustable jaw 16 to accommodate the threaded forward end of the shaft member 40, as illustrated in FIG. 4. After the work release stop member 25 is connected to the adjustable jaw 16, as illustrated in FIG. 1, the vise can be used in a conventional manner, without any interference from the work release stop member 25, by rotating the handle 20 to move the adjustable jaw 16 into and out of clamping position against a workpiece. The vise can also be quickly and easily adapted to provide repetitive clamping and unclamping of a particular size of workpiece, as illustrated at W in FIGS. 1 and 4.

To adjust the vise for the repetitive clamping and unclamping of a particular size of workpiece, it is merely necessary to rotate the handle 20 in a clockwise direction to move the adjustable jaw 16 into clamping engagement with the workpiece W, as illustrated in solid lines in FIG. 4. The handle 20 is then rotated a partial turn in a counterclockwise direction, as indicated in dotted lines in FIG. 1, to move the adjustable jaw 16 rearwardly to the release position shown in dotted lines in FIG. 4. The adjustment screw 35 is then screwed inwardly to cause the gripping jaws 32, 33 to spread apart and move into gripping engagement with the opposite side wall portions of the guideway slot 12 and fix the work release stop member 25 in position with the forward face of the washer 50 against the rear face of the adjustable jaw 16. The next workpiece W is then positioned between the adjustable jaw 16 and the fixed jaw 11 and the handle 20 is rotated a partial revolution in a clockwise direction to the solid line position in FIG. 1 so that the adjustable jaw 16 is moved into engagement with the rear face of the workpiece W. In this clamped position, the rear face of the adjustable jaw 16 is spaced a short distance from the forward face of the stop washer 50, usually a distance of one-sixteenth of an inch or less, depending upon the desired amount of clearance desired between the forward face of the adjustable jaw 16 and the rear face of the workpiece W when removing the workpiece from the clamped position.

To release the clamped workpiece W, it is merely necessary to move the handle 20 in a counterclockwise direction to the position illustrated in dotted lines in FIG. 1 to impart a partial rotation to the screw shaft 15 and move the adjustable jaw 16 rearwardly against the face of the stop washer 50. The workpiece W can be easily removed and a new workpiece positioned between the adjustable jaw 16 and fixed jaw 11. When the new workpiece W is so positioned, the handle 20 is then moved in a clockwise partial rotation to again move the adjustable jaw 16 forwardly into clamping engagement with the workpiece W. During both forward and rearward movements of the adjustable jaw 16, the compression spring 44 resiliently urges the adjustable jaw 16 rearwardly toward the work release stop member 25 and removes any "play" between the threaded screw shaft 15 and the internal threads of the depending guide 17 of the adjustable jaw 16.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a vise including an elongate base, a fixed jaw at one end of said elongate base, a guideway extending longitudinally along said base and from said fixed jaw to the opposite end thereof, a screw shaft journaled at each end of said base and extending along said guideway, an adjustable jaw supported for longitudinal movement on said base and including a depending guide extending into said guideway and having an internally threaded bore threadably receiving said screw shaft to permit movement of said adjustable jaw forwardly toward and rearwardly away from said fixed jaw and along said screw shaft upon rotation thereof, and handle means connected to said screw shaft for manually imparting rotation thereto, the combination therewith of adjustable stop means supported in said guideway and rearwardly of said adjustable jaw for engaging and limiting rearward movement of said adjustable jaw when releasing a workpiece clamping between said fixed jaw and said adjustable jaw, said adjustable stop means comprising a stop plate including an upper portion extending transversely of and above said guideway, said upper portion of said stop plate including lower shoulder portions on opposite sides thereof, said shoulder portions being supported on portions of said elongate base adjacent opposite sides of said guideway, and gripping jaw portions extending downwardly below said shoulder portions and engageable with respective oppositely facing sides of said guideway, and adjustment means for varying the transverse distance between said gripping jaw portions to maintain said stop plate in a selected longitudinally adjusted position in said guideway, said stop plate being vertically divided to define first and second transversely adjacent parts, a threaded connector joining adjacent upper ends of said first and second parts and being operable to vary the overall width of said stop plate, said adjustment means including an adjustment screw threadably supported in said second part of said stop plate and below said threaded connector and operativley engaging said first part for varying the distance between said lower gripping jaw portions, and wherein said adjustment means includes a bearing ball partially seated in said first part of said stop plate, said bearing ball being in alignment with and engageable by the inner end of said adjusting screw.

2. In a vise according to claim 1 including resilient means supported on said adjustable stop means and connected to said adjustable jaw for resiliently urging said adjustable jaw toward said adjustable stop means.

3. In a vise according to claim 2 wherein said resilient means includes a shaft member extending through said adjustable stop means and having a forward end threadably supported in said adjustable jaw, said shaft member including a rearwardly extending portion extending outwardly beyond said adjustable stop means, a compression spring surrounding said shaft member and having a forward end in engagement with said adjustable stop means, and means connecting the rearward end of said compression spring to the rearward end of said shaft member.

4. In a vise according to claim 3 wherein said means connecting said compression spring to said shaft member includes a screw having a forward end threadably mounted in the rear end of said shaft member, said screw being adjustable to vary the compressive force of said compression spring against said adjustable stop means.

5. In a vise according to claim 3 including a washer surrounding the forward end of said shaft member and positioned between said adjustable stop means and the rear of said adjustable jaw and providing a stop insert therebetween.

6. In a vise including an elongate base, a fixed jaw at one end of said elongate base, a guideway extending longitudinally along said base and from said fixed jaw to the opposite end thereof, a screw shaft journaled at each end of said base and extending along said guideway, an adjustable jaw supported for longitudinal movement on said base and including a depending guide extending into said guideway and having an internally threaded bore threadably receiving said screw shaft to permit movement of said adjustable jaw forwardly toward and rearwardly away from said fixed jaw and along said screw shaft upon rotation thereof, and handle means connected to said screw shaft for manually imparting rotation thereto, the combination therewith of adjustable stop means supported in said guideway and rearwardly of said adjustable jaw for engaging and limiting rearward movement of said adjustable jaw when releasing a workpiece clamped between said fixed jaw and said adjustable jaw, said adjustable stop means including a stop plate supported for longitudinal movement along said guideway and rearwardly of said adjustable jaw, means for fixing said stop plate in a selected adjusted position in said guideway, and resilient means supported on said stop plate and connected to said adjustable jaw for resiliently urging said adjustable jaw toward said stop plate, and wherein said resilient means includes a shaft member extending through said stop plate and having a forward end fixed in said adjustable jaw, said shaft member including a rearwardly extending portion extending through said stop plate, a compression spring surrounding said rearwardly extending portion of said shaft member and having a forward end in engagement with said stop plate, and means connecting the rearward end of said compression spring to the rearward end of said shaft member.

7. In a vise according to claim 6 wherein said means connecting said compression spring to said shaft member includes adjustment means for varying the compressive force of said compression spring against said stop plate.

8. In a vise according to claim 7 wherein said adjustment means includes a screw having a forward end threadably mounted in the rear end of said shaft member.

9. Adjustable stop means adapted for use in a vise including an elongate base, a fixed jaw at one end of said elongate base, a guideway extending longitudinally along said base and from said fixed jaw to the opposite end thereof, a screw shaft journaled at each end of said base and extending along said guideway, an adjustable jaw supported for longitudinal movement on said base and including a depending guide extending into said guideway and having an internally threaded bore threadably receiving said screw shaft to permit movement of said adjustable jaw forwardly toward and rearwardly away from said fixed jaw and along said screw shaft upon rotation thereof, and handle means connected to said screw shaft for manually imparting rotation thereto, said adjustable stop means adapted to be supported in said guideway and rearwardly of said adjustable jaw and adapted to engage and limit rearward movement of said adjustable jaw when releasing a workpiece clamped between said fixed jaw and said adjustable jaw, said stop plate including an upper portion extending transversely of and above said guideway, said upper portion of said stop plate including lower shoulder portions on opposite sides thereof, said shoulder portions being adapted to be supported on portions of said elongate base adjacent opposite sides of said guideway, gripping jaw portions extending downwardly below said shoulder portions and being adapted to engage with respective oppositely facing sides of said guideway, adjustment means for varying the transverse distance between said gripping jaw portions to permit said stop plate to be maintained in a selected longitudinally adjusted position in said guideway, wherein said stop plate is vertically divided to define first and second transversely adjacent parts, and further includes a threaded connector joining adjacent upper ends of said first and second parts and being operable to vary the overall width of said stop plate, and wherein said adjustment means includes an adjustment screw threadably supported in said second part of said stop plate and below said threaded connector and operatively engaging said first part for varying the distance between said lower gripping jaw portions, and wherein said adjustment means further includes a bearing ball partially seated in said first part of said stop plate, said bearing ball being in alignment with and engageable by the inner end of said adjusting screw.

10. Adjustable stop means according to claim 9 including resilient means supported on said adjustable stop means and being adapted to be connected to said adjustable jaw for resiliently urging said adjustable jaw toward said adjustable stop means.

* * * * *